US008466391B2

(12) United States Patent
Horsmann et al.

(10) Patent No.: US 8,466,391 B2
(45) Date of Patent: Jun. 18, 2013

(54) SUPPORT FOR AN ELECTRICAL HEATING DEVICE, ELECTRICAL HEATING DEVICE AND METHOD FOR THE MANUFACTURE OF AN ELECTRICAL HEATING DEVICE

(75) Inventors: Karl-Heinz Horsmann, Bernried (DE); Eugen Wilde, Knittlingen-Freudenstein (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 1266 days.

(21) Appl. No.: 12/261,773

(22) Filed: Oct. 30, 2008

(65) Prior Publication Data

US 2009/0188908 A1 Jul. 30, 2009

(30) Foreign Application Priority Data

Oct. 30, 2007 (DE) ..... 10 2007 053 349

(51) Int. Cl.
*H05B 3/06* (2006.01)
*H05B 3/00* (2006.01)

(52) U.S. Cl.
USPC ..... 219/532; 219/461.1; 219/446.1; 219/448.11; 219/448.12; 219/538; 219/540; 219/494; 219/448.17; 29/611

(58) Field of Classification Search
USPC ..... 219/532, 461.1, 446.1, 462.1, 448.11, 219/448.12, 443, 445, 538, 540, 494, 448.17; 29/611
See application file for complete search history.

(56) References Cited

U.S. PATENT DOCUMENTS

| | | | | |
|---|---|---|---|---|
| 3,612,826 | A | 10/1971 | Deaton | |
| 3,749,883 | A | 7/1973 | Vodvarka et al. | |
| 4,357,523 | A | 11/1982 | Bleckmann | |
| 4,380,116 | A | 4/1983 | Gössler et al. | |
| 4,634,841 | A | 1/1987 | Laughrey | |
| 5,369,874 | A * | 12/1994 | McWilliams | 29/611 |
| 7,131,725 | B2 | 11/2006 | Walh et al. | |
| 2001/0003335 | A1 * | 6/2001 | Griffiths et al. | 219/446.1 |
| 2005/0020143 | A1 | 1/2005 | Ross | |
| 2007/0278215 | A1 | 12/2007 | Schilling et al. | |

FOREIGN PATENT DOCUMENTS

| | | |
|---|---|---|
| DE | 520136 | 3/1931 |
| DE | 25 00 586 | 7/1976 |
| DE | 31 31 462 A1 | 2/1983 |
| DE | 37 17 728 A1 | 12/1988 |
| DE | 10 2005 025 896 A1 | 11/2006 |
| GB | 261525 | 11/1926 |
| JP | 2003-115427 | 4/2003 |

OTHER PUBLICATIONS

European Search Report from European Application No. 08017879.1.
German Search Report from German Application No. 10 2007 053 349.9.
German Search Report from German Application No. 10 2007 053 348.0.

* cited by examiner

*Primary Examiner* — Shawntina Fuqua
(74) *Attorney, Agent, or Firm* — Alston & Bird LLP

(57) ABSTRACT

An electrical heating device has an integrally manufactured support made from insulating material. Depressed paths for introducing a heating element are provided. A klixon functioning as a thermally actuated switch is inserted from above into an opening in the central area of the support and its electrical terminals project over the bottom side and are bent round for mechanical fixing.

15 Claims, 2 Drawing Sheets

SUPPORT FOR AN ELECTRICAL HEATING DEVICE, ELECTRICAL HEATING DEVICE AND METHOD FOR THE MANUFACTURE OF AN ELECTRICAL HEATING DEVICE

CROSS REFERENCE TO RELATED APPLICATIONS

This application claims priority to German Application Number 102007053349.9 filed on Oct. 30, 2007, the contents of which are incorporated by reference.

FIELD OF THE INVENTION

The invention relates to a support for an electrical heating device made from insulating material and on whose top side is placed at least one heating element. The heating element is elongated and runs in a path on the top side of the support. The invention also relates to an electrical heating device having such a support and to a method for the manufacture of such an electrical heating device.

BACKGROUND OF THE INVENTION

It is known from U.S. Pat. No. 5,369,874 to construct an electrical heating device in the form of a radiant heater with a similar support, in which the heating elements run in the form of strip heating conductors in slots in a prefabricated path on the top side of the support. At given intervals, the side walls of the paths are subject to secondary compression and press laterally against the strip heating conductors in order to mechanically secure the same. Protection against excess temperatures or a type of temperature sensor is constructed as a rod controller, which is known in the art, which is fixed to one side of the radiant heater and overlaps the heating elements and that extends there to the opposite side.

BRIEF DESCRIPTION OF THE DRAWINGS

Embodiments of the invention are described hereinafter relative to the attached diagrammatic drawings, wherein.

DETAILED DESCRIPTION OF THE EMBODIMENTS

Figure 1:
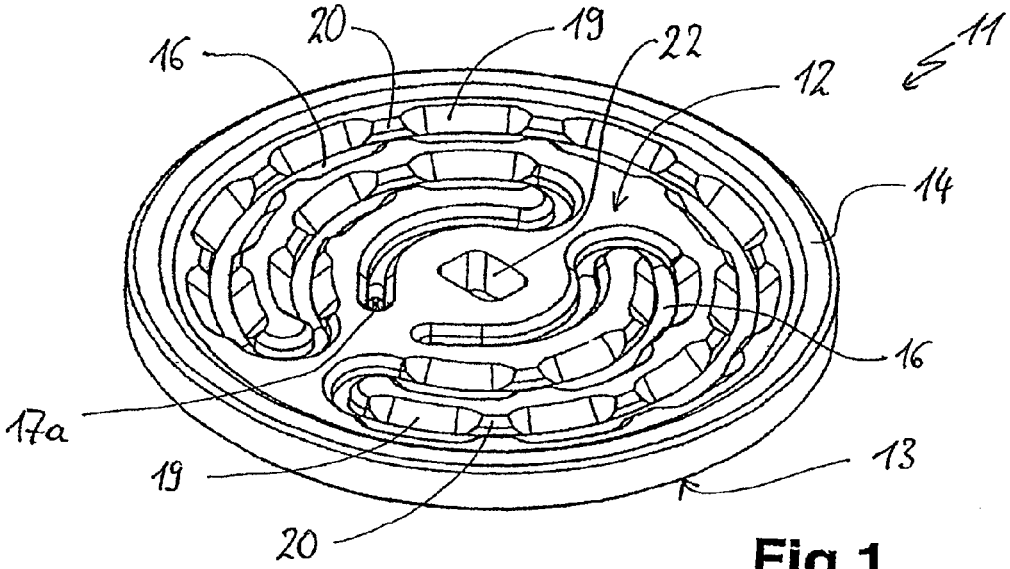
FIG. 1 illustrates a view sloping from above on a support according to one embodiment of the invention and without further additional parts.

Embodiments of the invention include to provide an aforementioned support, an electrical heating device with such a support and a method for the manufacture of such a heating device making it possible to obviate the problems and disadvantages of the prior art and to provide in a particularly simple manner a type of temperature sensor or klixon.

This problem is solved in one embodiment by a support having the features as claimed herein. Advantageous and preferred embodiments of the invention form the subject matter of the further claims and are explained in greater detail hereinafter. Some of these features are only described for one embodiment of the support, the heating device or the method, but independently thereof also apply to the other embodiments. By express reference the wording of the claims is made into part of the content of the description.

According to one embodiment of the invention, an opening is provided in a central area of the support through which can be inserted or passed through a so-called "klixon." Within the context of the present application a klixon is generally understood to mean a thermally operated or actuated switch, which is triggered by thermally released spring means, advantageously a bimetallic snap action disk and opens a contact, i.e. interrupts the current conduction on exceeding a given temperature. This given temperature is established by the construction of the bimetallic snap action disk. Hereinafter the term klixon is used for this, but the protective scope of the application of this term is not restricted to the term as described above. On the top side, the klixon projects over the opening, for example, with lateral projections in the form of wings, so that it cannot drop through. This insertion or passing through of the klixon advantageously takes place from the top side, so that the electrical connections or terminals of the klixon project over the bottom side of the support and/or can be reached there. By bending over the terminals or fixing a connecting device such as a plug or the fixing of connecting cables or the like, this reliably prevents the klaxon from moving back from this position or dropping out. In certain circumstances, it is not even necessary for the electrical terminals to project well beyond the bottom side. Here, a fitting of electrical terminals can take place in such a way that they overlap the opening in the support from the bottom side so that a moving back or dropping out of the klixon is impossible. In another embodiment of the invention, the klixon can be inserted in the reverse direction from bottom to top and then the indicated lateral projections are bent round on the top side to secure it against dropping out. In another embodiment of the invention, the klixon can be resiliently fixed to the support, for example by means of the aforementioned lateral wings or the like.

This type of fixing can be chosen both for one and for two klixons, if two such switches are required for two different temperature switching points. It is also possible to fit in this way a type of double klixon, which has two klixons in a single housing and four electrical terminals.

One aforementioned klixon can be used for a residual heat indication of the heating device, particularly when used in a hob. A further klixon can be used as an excess temperature protection so as to ensure that a temperature of 175 C is not exceeded on the top side of a glass ceramic hob plate, because such "keep-hot" heaters are normally not operated in cyclic manner and instead are operated permanently with a constant power after switching on.

In one embodiment, the support is entirely made from insulating material. It can be constructed in the manner of a flat disk or plate with a circumferential edge or rim on the top side. Said edge can project over the heating elements or the paths and side walls of said paths provided for the same, for example, by a few millimetres. Moreover, such a circumferential edge can also project over the klixon placed on the top side, so that no extra depressions have to be made for the same. The edge then engages on the underside of a hob plate.

In one embodiment, it is possible to make the underside or bottom side of the support substantially flat. Alternatively, at least one projecting fixing area can be provided on its bottom side and is preferably integrally shaped, i.e., simultaneously manufactured, but can alternatively be subsequently fixed, for example, by bonding. It is particularly advantageous to provide two such fixing areas on the bottom side and which, in particular, have an identical construction. Such a fixing area projects at least over the bottom side of the support and possibly also over the lateral edge. It can be used for fixing the support or the electrical heating device constructed therewith as a hotplate to a hob under a glass ceramic hob plate. For this purpose, the fixing area has at least one prefabricated opening into which can be screwed a fixing screw or the like. It is also possible to provide several such openings in order to permit a different positioning with a precision setting of the support.

In another development of the invention, the support can be made relatively thin, approximately 10 mm to 15 mm thick. The thermal insulation is adequately ensured if the finished heating device brings about no excessive temperature evolution. This is more particularly the case if the heating device is constructed as a so-called keep-hot heater. This means that in the case of the preparation of food, no high energy inputs are possible and instead a hotplate on a hob equipped with such a heating device is used for keeping hot a saucepan or food contained therein. For this purpose, the power of the heating element or the heating device can be between 100 and 150 Watts, particularly with a power density for the support of 0.6 $W/cm^2$.

Terminals or connections of the heating element for electrical connection purposes can advantageously be so guided in a central area of the support at a distance from the outer edge that they extend from a top side of the support through the latter to a bottom side and can be readily reached there for electrical contacting or mechanical fixing. The mechanical fixing can be facilitated by the electrical terminal. Thus, in a simple implementation, this means that the terminals or connection ends of the heating element are passed through the support and project from the bottom side and are connected there to a lead or a connecting cable. This makes it possible to bring about a simple electrical connection which does not, as is normally the case with other radiant heaters or similar heating device, necessarily have to occur on the edge and instead takes place in the central area. In addition, the terminals are mechanically fixed or secured against movement through the support material surrounding the same. Finally, by the fitting or connecting of the leads or connecting cables, it is possible to prevent the terminals moving back again or the heating element becoming detached from the support in this area. An electrical connection centrally on the bottom side of the support is in many cases more easily accessible than on the outside of the heating device.

Advantageously, connecting cables can be moved up to the terminals of the heating elements laterally or roughly parallel to the bottom side and are then connected, preferably welded thereto. This applies if the moved up connecting cables cross the terminals of the heating elements in such a way that they project over the opening for the passage of the terminals on both sides thereof and secure the terminals reliably against a moving back. Due to the resilience of the support, at least when the latter is made from a suitable insulating material, the terminals of the heating elements can be bent round by at least 30° to 45° and then connected to the connecting cables.

According to another embodiment of the invention, the paths for the heating elements are depressed in the support and at least sectorwise have side walls which run relatively close to the heating element. At least in part, the side walls or areas thereof are constructed for securing the heating elements in the paths against lifting from the support in such a way that they are so pressed in that at least on one side they slope over the path so as to overlap both the path and the heating element located therein so as to secure the same against lifting from the support. Thus, in this embodiment, a retaining side wall area is not located laterally on the heating element and instead overlaps it from above. It can admittedly engage on the heating element, but this is not necessary. Whereas only a frictional holding of the heating element in the path is possible in the case of lateral pressing against the heating element, as a result of an overlap of the side wall areas a positive holding action can take place, which is much more satisfactory. This is known from the aforementioned U.S. Pat. No. 5,369,874.

Alternatively, the heating element can be in the form of coiled wire, particularly coiled round wire and distorted from above. As a result, it engages with pressure on the side wall areas, which brings about the same retaining effect as described hereinbefore. In some cases it is even pressed somewhat into the side wall areas to ensure an even better retention.

These and further features can be gathered from the claims, description and drawings and the individual features, both singly and in the form of subcombinations, can be implemented in an embodiment of the invention and in other fields and can represent advantageous, independently protectable constructions for which protection is claimed here. The subdivision of the application into individual sections and the subheadings in no way restrict the general validity of the statements made thereunder.

Turning now to the figures, FIG. 1 shows an oblique view from above of an inventive support 11. The plate or disk-like support 11 has a top side 12 and a bottom side 13, a slightly raised edge or rim 14 running externally round the top side 12. The support 11 is integrally made from a suitable material in a single moulding process.

On the top side 12 is formed a path 16, which extends somewhat more deeply than half the thickness of the support. For a heating device, the path runs in a meandering-like manner with a few reversal turns and that starts and ends in a central area. In the latter is provided at least one hole 17*a*, which at the end of the path 16 passes through the support 11 to its bottom side 13. In addition to the holes 17*a* and 17*b* for the connections or terminals of the heating elements, an opening 22 is provided in the central area and through which can be passed, in the manner described hereinafter, a klixon as a temperature switch.

The path 16 also has different portions as widened areas 19 and projections 20 between the same. Following the insertion of the heating element, the projections 20 serve for pressing into the path and then pass over the path for overlapping and securing the heating element.

Figure 2:
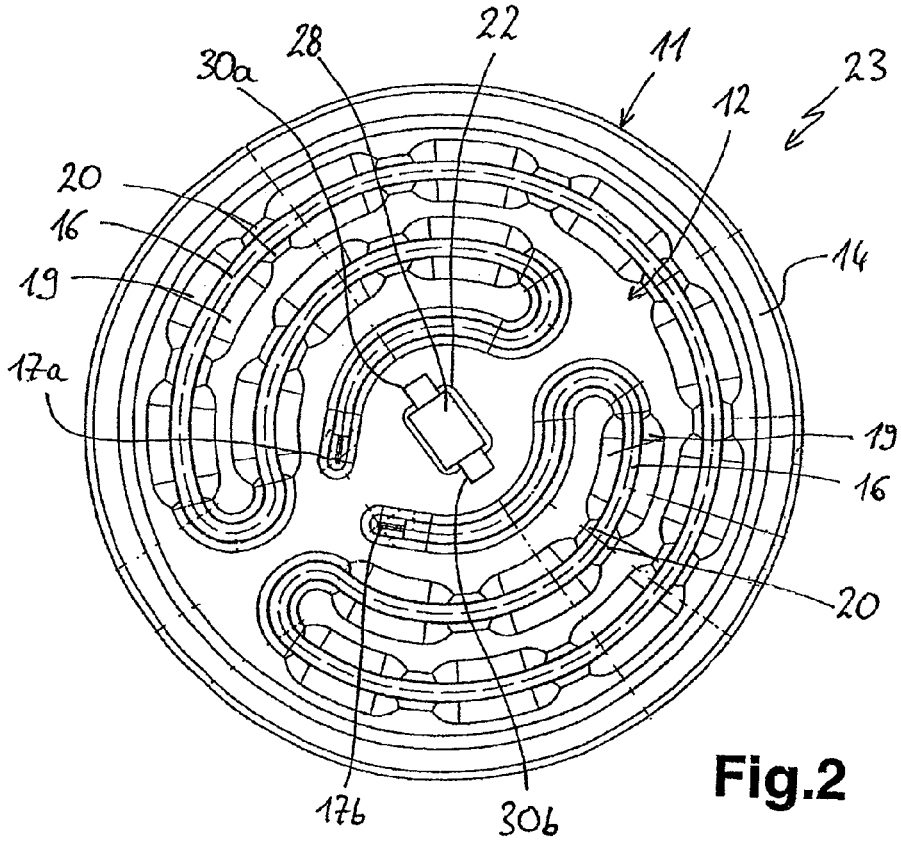
FIG. 2 illustrates a plan view of an electrical heating device according to one embodiment of the invention with a support according to FIG. 1 and the heating element and klixon located therein.

FIG. 2 is a plan view of an electrical heating device 23 comprising a support 11 according to FIG. 1 and where a heating element 24 is inserted in the path 16. The heating element 24 comprises a coiled round heating wire, for example, of a FeCrAl alloy. At the start and finish of the path 16, terminals 26*a* and 26*b* are passed through the corresponding holes 17*a* and 17*b*, as is more clearly visible in FIG. 3. After inserting the heating elements 24 in the path 16 according to FIG. 2, pressure is exerted from above on the projections 20, so that the latter are further deformed and slope inwards or are pressed inwards over the path 16 and consequently also over the heating element 24 therein. On overlapping they may, but need not necessarily, contact the heating elements 24.

A klixon 28 is inserted from above in opening 22, advantageously following the insertion of heating element 24 and compressing thereof. Lateral projections 30*a* and 30*b* project over the opening 22 and engage on the top side 12 of support 11. In certain circumstances they can also be pressed into corresponding depressions, so that the klixon 28 does not project over the plane of top side 12 and is instead countersunk.

Figure 3:
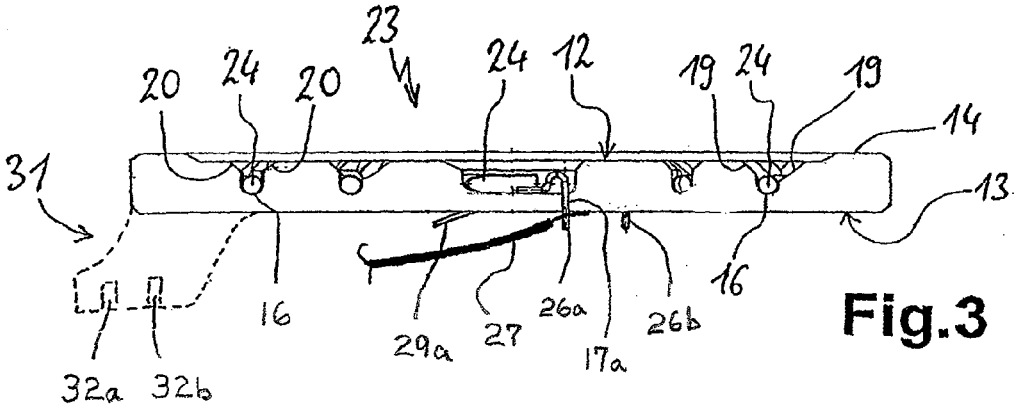
FIG. 3 illustrates a section through the heating device of FIG. 2.

Following the step of compressing or bending over the projections 20 and inserting the klixon 28, the electrical heating device 23 is in a state shown in section in FIG. 3. It can be seen that the projections 20 project over heating element 24, at least where they are provided and mechanically retain the same. It can also be seen how at least one terminal 26*a* extends through the hole 17*a* in support 11 past bottom side 13. Here a connecting cable 27 is led up to and welded to the end of terminal 26*a* projecting over bottom side 13. Thus, not only is there an electrical contacting, but also a mechanical fixing of terminal 26*a* to prevent it from moving back. The same occurs with respect to the other terminal 26*b*. A terminal 29*a* of the klixon is also shown and projects obliquely over the bottom side 13.

To the left in FIG. 3 is shown in broken line form a projecting fixing pin 31, which can in particular be integrally shaped on support 11 as a further development of the invention. It has on a bottom side two fixing holes 32, which are constructed so as to permit the engagement of conventional fixing screws which themselves cut a thread. Advantageously there are two such fixing pins 31, particularly on facing outer areas of support 11.

Figure 4:
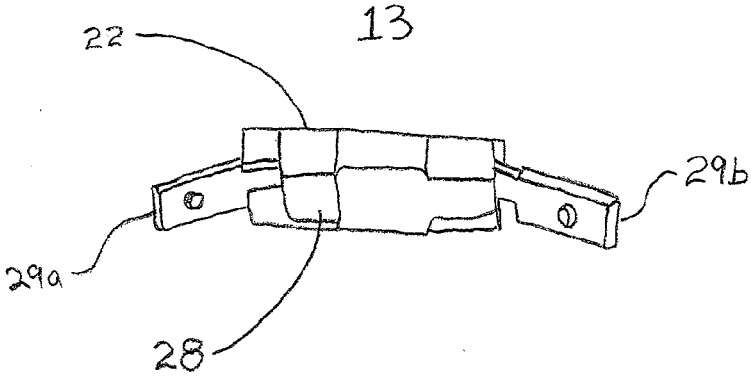
FIG. 4 illustrates an oblique view from below of the bottom side of the heating device of FIG. 3 with enlargement of the arrangement and fixing of a klixon.

FIG. 4 shows how a klixon 28 inserted from the top side 12 in opening 22 on bottom side 13 with its terminals 29*a*, 29*b* can not only be reached for an electrical contacting, for example by plugging in or welding. It can also be seen how the terminals 29*a* and 29*b* of klixon 28 project from opening 22 over bottom side 13 and are bent up outwards. This brings about a positive retention of klixon 28 on support 11, which can be very easily implemented and simultaneously allows a replacement of the klixon without particular effort, such as when repairing the unit when a malfunction occurs. Alternatively to a fixing of the klixon 28 by bending up terminals 29*a*/29*b*, a plugging in of one or more plugs can take place, which then at the bottom projects over opening 22 and thus brings about a retention of the klixon. The klixon 28 with projections 30 engages on the top side 12 of support 11 such that it cannot drop through the opening 22.

The invention claimed is:

1. A heating device comprising:

a support having a generally circular, flat form with a top side and a bottom side, said support having a path formed in the top side, said support having an opening located in a central area of said support, said path comprising a plurality of widened areas and a plurality of projections, wherein said path is configured to receive a continuous elongated heating element running in said path on said top side of said support, and said opening is configured to receive a klixon with electrical terminals positioned on said top side of said support, said electrical terminals passing through said opening from said top side in such a way that said terminals of said klixon project over said bottom side of said support, wherein said klixon comprising said electrical terminals and lateral projections, said klixon positioned on said top side of said support over said opening such that said lateral projections extend laterally over said opening engaging on said top side of said support, wherein said electrical terminals project through said opening past said bottom side of said support.

2. The heating device according to claim 1, wherein on said bottom side of said support is integrally shaped at least one fixing area of said support, said fixing area projecting over said bottom side of said support and being substantially flat.

3. The heating device according to claim 2, wherein said fixing area has at least one prefabricated opening for engagement of a fixing means, said opening being directed away from said support.

4. The heating device according to claim 1, wherein said electrical terminals laterally overlap said opening on said bottom side of said support thereby mechanically fixing said klixon to said support.

5. The heating device according to claim 1, wherein said klixon is resiliently fixed to said support.

6. The heating device according to claim 1, comprising:

said elongated heating element positioned in said path, said heating element being held in said path by contacting side walls of said path in the vicinity of said projections.

7. The heating device according to claim 1, comprising:

said elongated heating element positioned in said path, wherein said heating element is retained in said path by said projections of said path.

8. The heating device according to claim 6, wherein said heating element comprises a coiled shaped resistance wire.

9. The heating device according to claim 1, comprising:

said heating element wherein said projecting parts are located on said support, wherein said electrical terminals of said heating element pass through said support from said top side to said bottom side and project past said bottom side.

10. The heating device according to claim 9, wherein electrical connecting cables are fixed to said electrical terminals of said heating element on said bottom side of said support for electrical connection purposes and as a result said electrical terminals of said heating element are mechanically secured preventing removal of said heating element.

11. A method for manufacture of a heating device comprising a support having a generally circular flat form with a top side and a bottom side, said support having a path on said top side for receiving a heating element, said support having an opening in a central area of said support, said method comprising the steps of:

positioning a klixon comprising lateral projections and electrical terminals on said top side of said support, wherein said lateral projections laterally over said opening on said top side of said support, and wherein said electrical terminals pass through said opening in said central area of said support, such that said electrical terminals of said klixon project past said bottom side of said support.

12. The method according to claim 11, further comprising the step of:

bending at least one of said terminals of said klixon projecting past said bottom side of said support.

13. The method according to claim 11, further comprising the step of:

fixing an electrical attachment plug or electrical connecting cable to said klixon such that said attachment plug or said connecting cable projects over said bottom side of said support.

14. The method according to claim 11, further comprising the step of:

providing pressure onto a top side of said heating element after placing said heating element on said support in said path in such a way that said heating element is distorted so as to press onto side walls of said paths for fixing said heating element thereby preventing removal of said heating element from said path.

15. A heating device comprising:

a support comprising an insulating material having a top side and a bottom side, said support having a thickness and a circular shape, said top side having formed therein a curved path comprising a plurality of reversal turns, said path having a depth extending at least half the thickness of said support, wherein the path comprises a plurality of first sections comprising a widened portion and a plurality of second sections comprising projections, said path having a first end with a first hole through the support and a second end having a second hold through the support, said support comprising a central portion comprising a third hole;

a plurality of fixing areas attached to said support, said fixing areas positioned perpendicular to said support;

a heating element comprising coiled round resistance wire positioned in said path, wherein said heating element is retained within said path at least at said plurality of said second sections comprising said projections, said heating element having a first terminal passing through said first hole and a second terminal passing through said second hole; and a klixon comprising two electrical terminals and two lateral projections, said klixon located in the vicinity of said third hole such that said lateral projections contact said support on said top side and said electrical terminals passing through said third hole wherein said lateral projections and said electrical terminals retain said klixon in said third hole.

* * * * *